US005689152A

United States Patent [19]

Boutot et al.

[11] Patent Number: 5,689,152

[45] Date of Patent: Nov. 18, 1997

[54] ELECTRON MULTIPLIER FOR A MULTI-CHANNEL PHOTOMULTIPLIER TUBE

[75] Inventors: Jean-Pierre Boutot; Pierre L'Hermite, both of Brive, France

[73] Assignee: U.S. Philips Corporation, New York, N.Y.

[21] Appl. No.: 622,486

[22] Filed: Mar. 26, 1996

[30] Foreign Application Priority Data

Apr. 26, 1995 [FR] France ..... 95 04979

[51] Int. Cl.[6] ..... H01J 43/18

[52] U.S. Cl. ..... 313/532; 313/529; 313/533; 313/537; 313/103 R; 313/105 R

[58] Field of Search ..... 313/532, 533, 313/534, 529, 530, 537, 542, 103 R, 103 CM, 105 R, 105 CM

[56] References Cited

U.S. PATENT DOCUMENTS

| | | | |
|---|---|---|---|
| 2,285,848 | 6/1942 | Van Den Bosch | 313/105 R |
| 2,342,986 | 2/1944 | Van Den Bosch | 313/533 X |
| 2,408,709 | 10/1946 | Van Den Bosch | 313/105 R |
| 2,617,948 | 11/1952 | Kallmann | 313/105 R X |
| 4,649,269 | 3/1987 | Persyk | 313/105 R X |
| 4,649,314 | 3/1987 | Eschard | 313/103 R X |
| 4,816,718 | 3/1989 | Lavoute et al. | 313/534 |
| 4,980,604 | 12/1990 | L'Hermite | 313/533 |
| 5,126,629 | 6/1992 | Chopy | 313/533 |
| 5,416,382 | 5/1995 | L'Hermite | 313/533 X |
| 5,598,060 | 1/1997 | L'Hermite | 313/533 X |

FOREIGN PATENT DOCUMENTS

| | | | |
|---|---|---|---|
| 155377 | 9/1985 | European Pat. Off. | 313/533 |
| 2654552 | 5/1991 | France . | |
| 2268623 | 1/1994 | United Kingdom | 313/532 |

*Primary Examiner*—Hezron E. Williams
*Assistant Examiner*—Daniel S. Larkin
*Attorney, Agent, or Firm*—Robert J. Kraus

[57] ABSTRACT

An electron multiplier of the perforated sheet type includes two successive sheets constituting a dynode which has several multiplier channels in common. For controlling the gain of a given channel (A), a control electrode (30) is provided in the form of a sheet inserted between the sheets (14, 15) of a dynode (Dn) which has a grating window (33) controlling the gain of the channel (A) in question, and one (or several) aperture(s) (34) in accordance with the number of remaining channels. Another channel (B) is controlled by another electrode (31) inserted between the sheets (16, 17) of another dynode ($D_{n+1}$). Also disclosed is a multi-channel photomultiplier tube which includes such an electron multiplier.

9 Claims, 3 Drawing Sheets

ELECTRON MULTIPLIER FOR A MULTI-CHANNEL PHOTOMULTIPLIER TUBE

BACKGROUND OF THE INVENTION

The invention relates to a multi-channel electron multiplier of the type comprising a plurality of conductive sheets stacked parallel to each other, in which two adjacent sheets intended to convey the same voltage constitute, in the direction of displacement of the electrons, a focusing half-dynode and a multiplying half-dynode, respectively, jointly constituting a dynode which has different channels in common, each sheet comprising active zones in a number which is equal to the number of channels which are perforated by a regular configuration of apertures, and comprising unapertured separation zones.

An electron multiplier of this type is known from the document U.S. Pat. No. 5,126,629. It provides a multi-channel photomultiplier tube construction which is economical because of the simplicity of the parts constituting the multiplier.

A good homogeneity of the output current response of the different multiplier channels for a uniform electron flux at the input is desirable in the majority of applications. When gamma-ray medical imaging is concerned, the replacement of single-channel photomultiplier tubes by multi-channel tubes is only envisageable if this homogeneity of response between channels and the homogeneity of one tube with the other can be realised. Therefore, a solution which is very much desirable is that a multi-channel electron multiplier of the type described hereinbefore can be realised which is very simple and economical and in which the gain of each channel is adjustable.

SUMMARY OF THE INVENTION

It is a particular object of the invention to propose an electron multiplier of the type having an adjustable gain, as well as a multi-channel photomultiplier tube provided with such an electron multiplier.

According to the invention, a multi-channel electron multiplier comprising a plurality of apertured sheets constituting dynodes which have different channels in common is characterized in that, for controlling the gain of a given channel, the multiplier comprises a control electrode in the form of a sheet which is situated between the sheets of a dynode, having a window provided with a grating which is highly transparent to electrons and the area of which is situated opposite the active zone of said given channel, while said electrode has apertures opposite the active zones of the other channels, and in that the control electrode is provided with connection means for applying an adjustable voltage.

As the electric field between the two sheets constituting a dynode is relatively weak (because these sheets are polarized at the same voltage), the control electrode acts very efficiently on the gain of the stage considered, even at moderate potential differences between the electrode and the dynode. In practice, it has been found that a very sufficient control range of voltages applied to the control electrode is obtained if these voltages are comprised between those of the two dynodes situated at both sides of the dynode in which the electrode is inserted. In fact, only the range of voltages between that of the dynode whose gain is controlled and that of the neighbouring dynode having a lower voltage can be used. In this range of voltages, the gain of the stage may be reduced from its nominal value to less than 10% of this value.

A preferred embodiment of the invention, in which N is the number of electron multiplier channels, is characterized in that a control electrode is each time arranged between the two sheets of N successive dynodes of the multiplier, while the window of said electrode provided with a grating is successively positioned opposite the active zone of each one of the N channels.

The N successive dynodes preferably occupy a substantially central position in the multiplier, i.e. for example for a multiplier having four channels and ten dynodes, the controllable gain dynodes occupy the positions 4 to 7.

The window of the control electrode may be provided with a wire grating which may have a relatively large pitch. However, to remain within the same technique used for the dynodes, the control electrode advantageously has apertures situated opposite the apertures of the active zone of the focusing half-dynode adjacent thereto, said apertures having a diameter which is larger than that of the apertures of said half-dynode.

The invention also relates to a photomultiplier tube having an envelope with an input window, an inner face of which is provided with a photocathode, an electron-optical system splitting up the photoelectrons into several beams, and a plurality of anodes, and is characterized in that said tube comprises an electron multiplier having an adjustable gain as defined hereinbefore.

In accordance with a preferred embodiment, the photomultiplier tube is of a type in which the envelope consists of a head having a polygonal section which is provided at one end with the input window and is connected at the other end to a body having a smaller section than that of the head, which body has connection pins at its end opposite the head, and is characterized in that the electron-optical system realising the convergence of electrons emitted by the photocathode on the different multiplier channels is constituted by a plate whose surface extends substantially throughout a section of the tube which is adjacent to the connection between the body and the head, which plate is provided with means for connecting it to a voltage which is equal to that of the photocathode and has a central aperture which is flush with an input grating of a first dynode of the tube which is of a type having partitioned compartments, while the rest of the head is maintained at a voltage which is equal to that of the photocathode.

These and other aspects of the invention will be apparent from and elucidated with reference to the embodiments described hereinafter.

DESCRIPTION OF THE PREFERRED EMBODIMENTS

Figure 1:
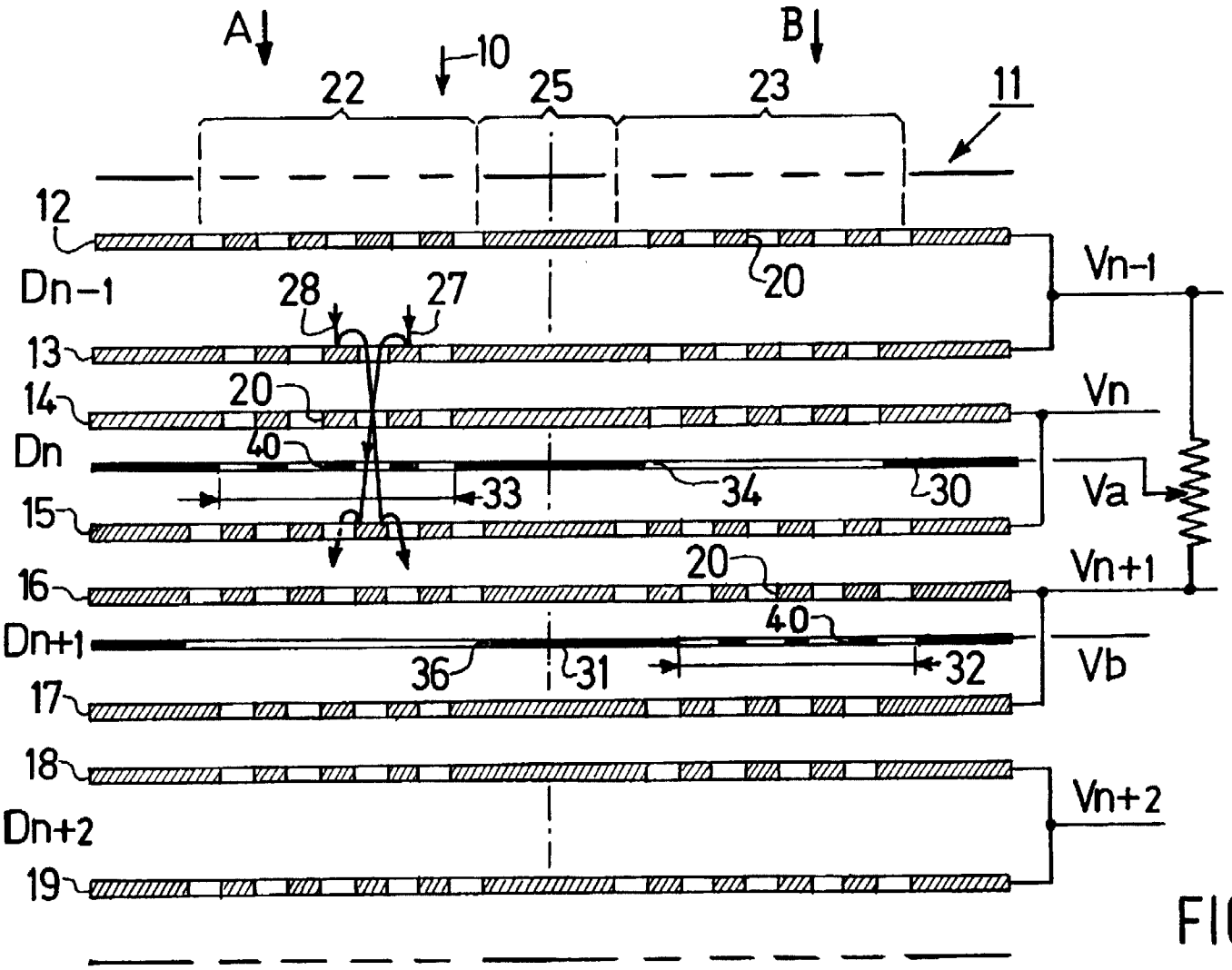
FIG. 1 is a diagrammatic and partial cross-section of an electron multiplier according to the invention.

FIG. 1 shows diagrammatically a part of an electron multiplier 11 according to the invention, which part is limited to four dynodes $D_{n-1}$ to $D_{n+2}$. The multiplier is constituted by conductive sheets ganged parallel to each other. The dynode $D_{n-1}$ is constituted by two adjacent sheets which, in the direction of displacement of the electrons denoted by the arrow 10, constitute a focusing half-dynode 12 and a multiplying half-dynode 13, respectively, both conveying the same voltage $V_{n-1}$. The next dynode $V_n$ is constituted in the same manner, i.e. a focusing half-dynode 14 and a multiplying half-dynode 15 both conveying the same voltage $V_n$ which is higher than the voltage $V_{n-1}$ of the preceding dynode. The same applies to the half-dynodes 16, 17 constituting the dynode $D_{n+1}$ conveying the voltage $V_{n+1}$, and the dynode $D_{n+2}$ formed from two half-dynodes 18 and 19.

Each sheet of a half-dynode comprises active zones 22, 23 having a regular configuration of apertures 20 and separation zones 25 which are complete, i.e. unapertured. The active zones 22 of the different dynodes are aligned in the axial direction of the electron multiplier 11 and form a multiplier channel A which is different from the channel B formed by the active zones 23 aligned axially in another part of the dynodes. FIG. 1 shows the cross-section of a two-channel electron multiplier, at the center of the dynodes.

The separation zone 25 is intended to minimise crosstalk between the two channels which are constituted by aligning the active zones 22 and 23 of all the dynodes.

As has been shown in the Figure, the sheets which constitute a dynode have two multiplier channels in common.

In order to be able to control the gain of one channel with respect to the other, the multiplier 11 comprises a control electrode 30 in the form of a sheet which is situated between the sheets 14 and 15 constituting the dynode Dn. It has a window 33 which is provided with a grating which is highly transparent to the electrons and whose surface is situated opposite the active zones 22 of the other dynodes for the channel A, while this electrode 30 has an aperture 34 opposite the active zones 23 of the other dynodes for the channel B. The control electrode 30 is fixed in an insulated manner with respect to the dynode Dn and comprises means (not shown) for polarizing this control electrode at an adjustable voltage $V_a$ which may be between $V_{n+1}$ and $V_{n-1}$ as has been indicated diagrammatically. The control electrode 30 influences the field between the sheets 14 and 15, which is a weak field because these sheets are polarized at the same voltage. Its effect is to raise or reduce, in accordance with the value of the voltage $V_a$, the number of electrons multiplied by the half-dynode 15 which are capable of going back to the next dynode $D_{n+1}$. As regards the channel B, the control electrode 30 is inactive and does not have any effect on the gain of this channel because the aperture 34 does not at all modify the field of the active zone 23 of the dynode Dn.

The channel B is controlled by another control electrode 31 which is analogous to the control electrode 30 but is situated between the sheets 16 and 17 of the dynodes $D_{n+1}$. Here, the window 32 of the control electrode has a grating which is highly transparent to electrons opposite the active zones 23 of the dynodes, thus permitting, by way of a control voltage Vb applied to this electrode, the modification of the multiplication factor of the dynode $D_{n+1}$ as regards the channel B.

In its turn, the control electrode 31 has an aperture 36 opposite the active zones 22 of the dynodes, such that the channel A is not influenced by this control electrode 31.

In the example shown in FIG. 1 by way of a grating which is highly transparent to the electrons, the control electrodes 30 and 31 are provided with apertures 40 situated opposite the apertures 20 of the active zone of the focusing half-dynodes which are adjacent thereto and constituted by sheets 14 and 16, respectively. These apertures 40 have a diameter which is larger than the diameter of the apertures 20 of these half-dynodes. While observing the trajectories of the electrons shown at 27 and 28, it is easy to understand that the apertures 40 of the control electrodes do not influence the trajectory of the electrons which are directed towards the multiplier half-dynode, because these electrons have acquired a relatively high kinetic energy.

After multiplication, the electrons occur at a very low kinetic energy and their trajectory will be greatly influenced by the voltage difference between the control electrode and the dynode in which this electrode is inserted.

FIG. 1 shows a part of a two-channel electron multiplier, but it is also possible to apply the same technique to a multiplier having a larger number of channels, for example, four. In this case, four control electrodes inserted in four successive dynodes of the multiplier are used, and each of these control electrodes permits modification of the gain of one of the channels. It is preferable that the dynodes which comprise the control electrodes are dynodes arranged substantially in the centre of the multiplier, that is to say, the rank of the dynode n in the example substantially corresponds to half the number of dynodes.

Figure 2:
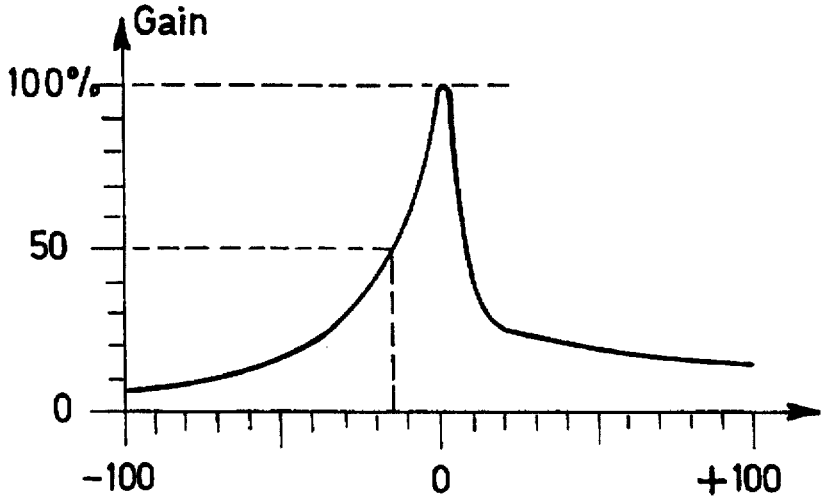
FIG. 2 is a curve relating to the gain of a dynode stage as a function of the voltage applied to a control electrode.

FIG. 2 shows an example of a practical plot of the gain of a stage of the dynode $D_n$ as a function of the voltage $V_a$–$V_n$ applied to a control electrode situated within this dynode between the two constituent sheets. While the control electrode is polarized at the same voltage as the dynode, the gain of the stage is nominal and denoted as 100% in the Figure. While the control electrode is polarized at −100 V with respect to the dynode, the gain is not more than 6% of its nominal value. A decrease by half the gain of the stage is obtained at a polarization of the control electrode of −15 V. In the sense of positive polarizations, the experimental curve obtained is less favourable because it decays very rapidly for a voltage of +10 V with respect to the dynode while it does not vary very much between +20 V and +100 V, which represents a less favourable control dynamic range.

Figure 3A:
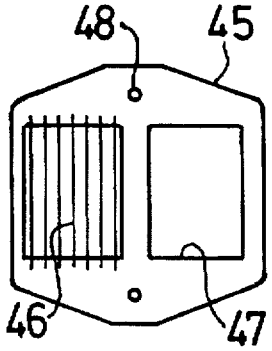
FIG. 3 shows embodiments of control electrodes in a multiplier according to the invention.

FIG. 3 is a plan view of several examples of control electrodes. FIG. 3A shows a control electrode 45 for a two-channel electron multiplier, which electrode has a window 46 provided with a wire grating which permits the control of the left channel of the multiplier in which this electrode is inserted, and an aperture 47 which leaves the right channel free and does not perform any correction on this channel.

Figure 3B:
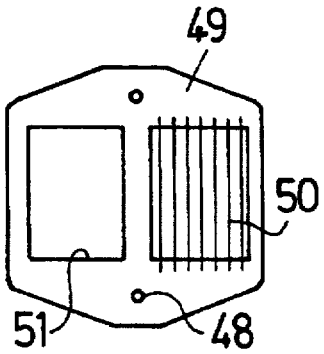

FIG. 3B shows another control electrode 49 for the same electron multiplier which permits, by way of the grating window 50, the control of the right channel, while an aperture 51 leaves the left channel free. In FIGS. 3A and 3B, apertures for fixing the electrode are denoted by the reference numeral 48.

Figure 3C:
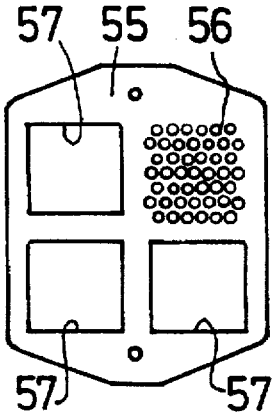

FIG. 3C shows an example of a control electrode 55 for a four-channel electron multiplier. It has a grating 56 which is highly transparent and is formed in this case as a configuration of apertures, similarly as in the example of FIG. 1. Three apertures 57 are provided for the three other channels which are not controlled by this electrode.

Figure 4:
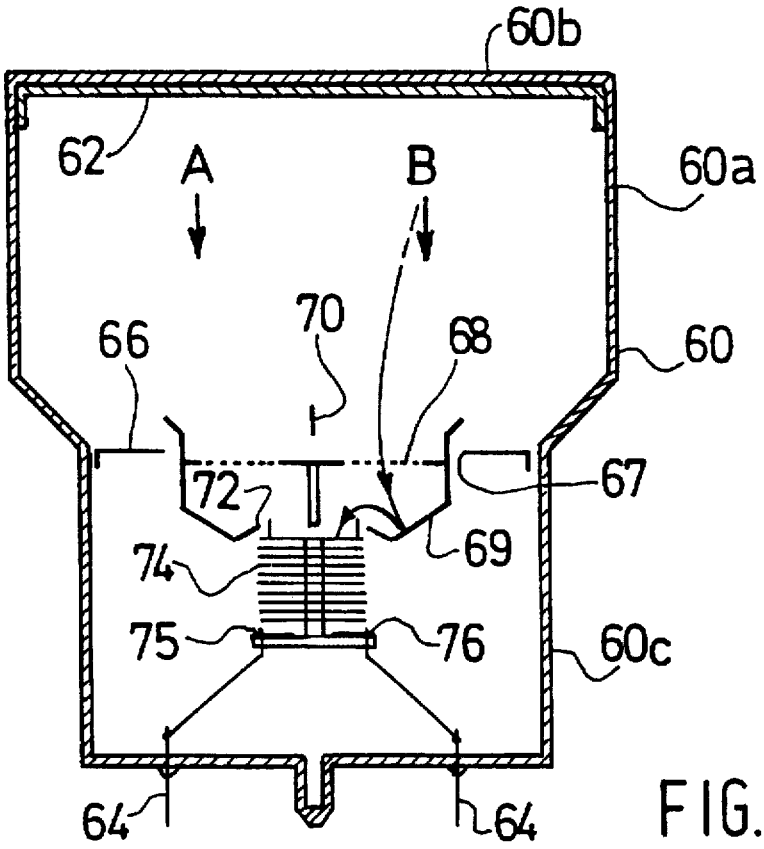
FIG. 4 is a diagrammatic sectional view of a photomultiplier tube according to the invention.

FIG. 4 is a diagrammatic cross-section of a two-channel photomultiplier tube. It comprises a glass envelope 60 with a head having a polygonal section **60*a*, for example, a rectangular section, which is provided with an input window 60*b*, an inner face of which is provided with a photocathode 62, and a body 60c having a smaller section than that of the head 60a. The body 60c, which generally has a circular section, is connected to the head 60a at one of its ends and has connection pins 64** at its other end.

An electron-optical system is necessary in this tube for splitting up the electrons emitted by the photocathode 62 into two beams and for directing them into the two parts of the tube forming the left channel A and the right channel B.

This optical system comprises a plate 66 whose surface extends substantially throughout a section of the tube which is adjacent to the connection between the body 60c and the head 60a, which plate has a diameter which is slightly smaller than that of the body 60c so that it can be introduced when the connection between the head 60a and the body 60c of the envelope has already been established. A central aperture 67 of the plate 66 is flush with the grating 68 of a first dynode 69 which is of a type having an input grating and partitioned compartments, which dynode 69 will hereinafter be described in greater detail.

A central strip 70 which extends in the perpendicular plane of the drawing of FIG. 4 is fixed to the plate 66, which strip extends beyond the central aperture 67 of the plate 66. The plate 66 is provided with the necessary means for connecting it to a voltage which is equal to that of the photocathode, and the same voltage is also applied to the strip 70. This creates a modification of the electric field which develops in the head 60a and is favourable for splitting up the electrons into two beams in accordance with the two channels A and B of the tube.

A passage 72 of the first dynode 69 of the tube is flush with the input dynode of an electron multiplier 74 comprising control electrodes such as described hereinbefore. Two anodes 75 and 76 collecting the electrons from each of the two channels of the tube are arranged at the output of the electron multiplier 74.

Figure 5:
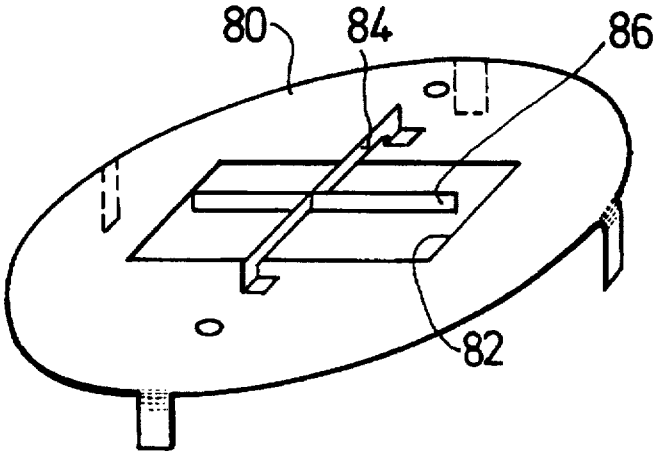
FIGS. 5 and 6 are perspective views of two parts in the structure of the tube of FIG. 4.

FIG. 5 is a perspective view of a plate 80 which is similar to the plate 66 of the tube of FIG. 4, but is intended for a four-channel tube. To this end, the plate 80 has a central aperture 82 above which two strips 84 and 86 are arranged cross-wise. The strip 84 is homologous with the strip 70 of FIG. 4, while the strip 86 creates a supplementary division of the electron beam for splitting it up into four paths instead of two as in FIG. 4.

Figure 6:
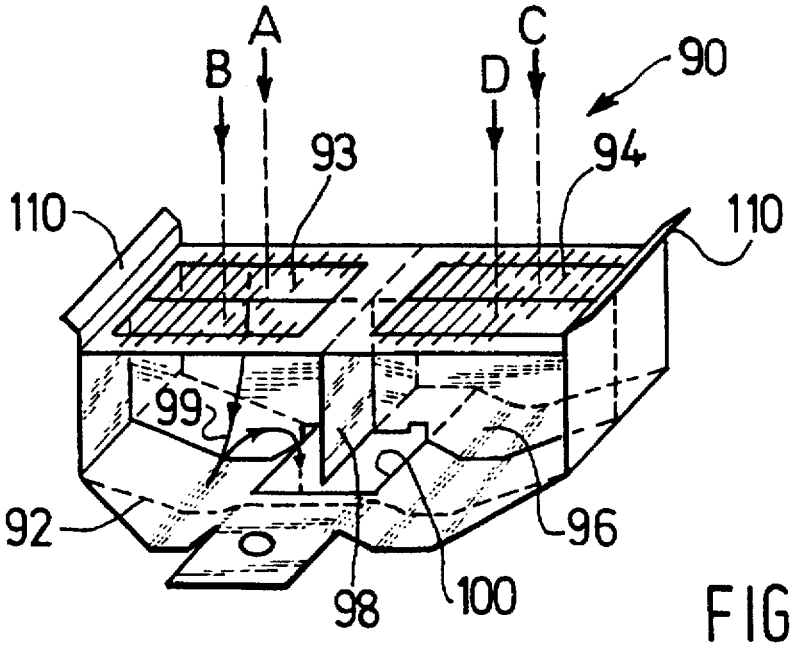

FIG. 6 is a perspective view of a dynode 90 of the type having an input grating and partitioned compartments. The dynode 90 shown in this Figure corresponds to the dynode 69 of FIG. 4, but is modified so as to be adapted to a four-channel photomultiplier. The dynode compartment has been opened for the sake of clarity of the Figure, while the partition, before being removed, is connected to the rest of the dynode along the broken line 92. A wire grating 93 constitutes the input of the dynode 90 for two channels A and B, while a further grating 94 constitutes the input for the channels C and D. The dynode 90 has four compartments bounded by partitions arranged crosswise, one partition 96 being arranged in the central plane parallel to the plane of the Figure and another partition 98 being arranged centrally and perpendicularly to the preceding partition. An electron trajectory within the dynode 90 is represented at 99. The multiplied electrons leave the dynode 90 via a central passage 100 so as to be directed towards the input dynode of the multiplier, which dynode is flush with the plane of passage 100.

To accentuate the division of photoelectrons at both sides of the compartment 98, the dynode 90 has inclined edges 110 which influence the distribution of the electric field in the photomultiplier tube. As is shown in FIG. 4, the edges of the dynode extend beyond the aperture 67 of the plate 66. They may be folded at an angle of 45° after assembly of the dynode with the plate 66, or formed from parts which are soldered together after assembly.

It will be evident that the embodiments of the invention described by way of example may be subjected to modifications of details known to those skilled in the art without passing beyond the scope of the appendant claims.

We claim:

1. A multi-channel electron multiplier of the type comprising a plurality of conductive sheets stacked parallel to each other, in which two adjacent sheets intended to convey the same voltage constitute, in accordance with the direction of displacement of the electrons, a focusing half-dynode and a multiplying half-dynode, respectively, jointly constituting a dynode which has different channels in common, each sheet comprising active zones in a number which is equal to the number of channels, which are perforated by a regular configuration of apertures, and comprising unapertured separation zones, characterized in that, for controlling the gain of a given channel, the multiplier comprises a control electrode in the form of a sheet which is situated between the sheets of a dynode, having a window provided with a grating which is highly transparent to the electrons and the area of which is situated opposite the active zone of said given channel, while said electrode has apertures opposite the active zones of the other channels, and in that the control electrode is provided with connection means for applying an adjustable voltage.

2. An electron multiplier as claimed in claim 1, in which N is the number of channels, characterized in that a control electrode is each time arranged between the two sheets of N successive dynodes of the multiplier, while the window of said electrodes provided with a grating is successively positioned opposite the active zone of each one of the N channels.

3. An electron multiplier as claimed in claim 2, characterized in that, in the direction of displacement of the electrons, the N successive dynodes occupy a substantially central position in the multiplier.

4. An electron multiplier as claimed in claim 1, characterized in that the grating, which is highly transparent to the control electrode, is constituted by a zone of this electrode which has apertures situated opposite the apertures of the active zone of the focusing half-dynode adjacent thereto, said apertures having a diameter which is larger than that of the apertures of said half-dynode.

5. A photomultiplier tube having an envelope with an input window, an inner face of which is provided with a photocathode, an electron-optical system splitting up the photoelectrons into several beams, and a plurality of anodes, characterized in that said tube comprises an electron multiplier having an adjustable gain as claimed in any one of claims 1 to 4.

6. A photomultiplier tube as claimed in claim 5, in which the envelope consists of a head having a polygonal section and is provided at one end with the input window and connected at the other end to a body having a smaller section than that of the head, which body has connection pins at its end opposite the head, characterized in that the electron-optical system realising the convergence of electrons emitted by the photocathode on the different multiplier channels is constituted by a plate whose surface extends substantially throughout a section of the tube which is adjacent to the connection between the body and the head, which plate is provided with means for connecting it to a voltage which is equal to that of the photocathode and has a central aperture which is flush with an input grating of a first dynode of the tube which is of the type having partitioned compartments, while the rest of the head is maintained at a voltage which is equal to that of the photocathode.

7. A photomultiplier tube as claimed in claim 6, characterized in that the input dynode of the electron multiplier having an adjustable gain is positioned in a central passage provided in the first dynode of the tube.

8. A photomultiplier tube as claimed in claim 7, characterized in that, in a two-channel tube, the first dynode comprises a central inner compartment, while one strip is electrically connected and fixed to the plate and extends beyond the central aperture running straight on from the inner compartment.

9. A photomultiplier tube as claimed in claim 7, characterized in that, in a four-channel tube, the first dynode comprises two central inner compartments arranged crosswise, and in that two strips arranged crosswise are fixed to the plate and extend beyond the central aperture in running straight on from the inner compartments.

* * * * *